US008323455B1

(12) United States Patent
Jones et al.

(10) Patent No.: US 8,323,455 B1
(45) Date of Patent: Dec. 4, 2012

(54) VENT SCRAPING APPARATUS FOR A CARBONIZING MACHINE

(76) Inventors: Fred L. Jones, Canton, MI (US); James Kowalczyk, Saginaw, MI (US)

( * ) Notice: Subject to any disclaimer, the term of this patent is extended or adjusted under 35 U.S.C. 154(b) by 622 days.

(21) Appl. No.: 12/589,373

(22) Filed: Oct. 22, 2009

(51) Int. Cl.
*C10B 43/06* (2006.01)

(52) U.S. Cl. ..... 202/241; 15/104.16; 202/118; 202/254

(58) Field of Classification Search ..... 202/117, 202/118, 241, 254; 201/2; 48/87, 126; 208/48 R; 196/122; 15/104.16
See application file for complete search history.

(56) References Cited

U.S. PATENT DOCUMENTS

| | | | | |
|---|---|---|---|---|
| 735,493 | A * | 8/1903 | Gayner | 202/254 |
| 1,135,498 | A * | 4/1915 | Carpenter | 202/241 |
| 5,017,269 | A | 5/1991 | Loomans et al. | |
| 2010/0236915 | A1 * | 9/2010 | Freel et al. | 202/241 |

* cited by examiner

*Primary Examiner* — Jill Warden
*Assistant Examiner* — Joye L Woodard
(74) *Attorney, Agent, or Firm* — Robert L. McKellar; McKellar IP Law, PLLC

(57) ABSTRACT

A vent scraping apparatus (10) includes a mount (20) fixably attached a carbonizing machine (14) at an opening (18) in the carbonizing machine. A duct (28) is fixably attached within the mount (20). The duct (28) conducts gas vented from the carbonizing machine. A scraper (24) is movably attached between the mount (20) and the duct (28). The scraper (24) slides between an inner surface (22) of the mount (20) and an outer surface (30) of the duct (28). The scraper (24) includes a leading edge (36) for scraping an inner surface (44) of the carbonizing machine opening (18) as the scraper is extended.

33 Claims, 13 Drawing Sheets

VENT SCRAPING APPARATUS FOR A CARBONIZING MACHINE

FIELD OF THE INVENTION

The invention herein disclosed and claimed relates to carbonizing of organic waste material into useful char product and, more particularly, to a vent scraper apparatus for a carbonizing machine.

BACKGROUND OF THE INVENTION

The apparatus to be disclosed involves certain novel, useful, and unobvious improvements to a machine used to convert organic waste material into a char material through a process of carbonizing or pyrolysis. Conversion of municipal solid waste (MSW) by incineration has become objectionable due to the release of fumes and smoke that contribute to pollution. In addition, incineration plants typically require additional inputs of expensive energy yet fail to recover of useful products that could offset the cost of incineration. Burying MSW in landfill areas is also objectionable due to the tremendous volumes of waste generated and the scarcity of landfill areas.

Municipal waste and other biomass may be converted to energy and useful products by a carbonizing process as disclosed, for example, in U.S. Pat. No. 5,017,269 to Loomans et al, which is incorporated by reference. Organic material is subjected to a sequence of mechanical compression, intensive mixing, and decompression in a continuous, twin screw reactor under adiabatic conditions. The intensive mixing subjects the organic material to frictional and viscous shear forces that create heat build up and particle attrition sufficient to change the phase of the particles and to convert their form. This is in contrast to extensive mixing which merely creates a most homogenous distribution of neat ingredients without changing their or converting their form. As a result of the carbonizing process, the organic material gives up volatile hydrocarbons, which may be captured or combusted immediately to provide energy to power the conversion apparatus. Further, at the end of the process, the organic material is completely converted into a char material of exceptional quality that may be sold as a replacement for, or supplement to, high-grade coal.

Referring now to FIGS. 17 through 18, an exemplary carbonization machine is shown in greater detail. FIG. 17 shows the exemplary carbonizing machine 400 in cross-sectional view. FIG. 18 shows a top view of the carbonizing machine. FIGS. 17 and 18 only show a portion of the overall carbonizing machine 400, focusing on the portion of the machine from an organic material input hopper 450 to just beyond a third gas vent 460. It should be understood by reference to the Loomans et al patent that the carbonizing machine 400 will further include an opening to output converted char material, among other features.

Referring now particularly to FIG. 17, the carbonizing machine 400 includes dual screws 424 in a chassis 420. The dual screws 424 extend through the chassis 420 by traversing a series of barrel sections 428, 432, 436, 440, 444, and 448. The dual screws 424 take on several distinct, complex, and complimentary screw and paddle designs and orientations. Generally, the dual screws 424 are designed and oriented to perform the tasks of (1) moving the organic material in a leftward direction from the input hopper 450, (2) imparting work energy into the organic material through shredding, chopping, grinding, intensive mixing, and compression to thereby heat the organic material, (3) maintaining near adiabatic conditions, and (4) staging the outflow of gases from the organic material to thereby perform a controlled and highly repeatable conversion into char.

Organic material, such as municipal solid waste (MSW), is shredded, ground, and dried before it is fed into a first barrel section 428 of the machine 400 through a feed port hopper 450. In the first barrel section 428, for example, the dual screws 424 are helical with lenticular cross-sections and primarily designed to advance the organic material. Immediately downstream of the first barrel section 428 is a second barrel region 432. In the second barrel region 432, the dual screws 424 transition to, for example, radially abutting paddles that are progressively axially angularly out of phase or offset to the screw shaft. In addition, axially adjacent paddles on each shaft are arranged in helical formation. Toward the downstream end of the second barrel section 432, the dual screws incorporate a reverse helical formation to exert a counter-stream flow force on the material. This counter-stream force causes the material to be further compressed.

As the organic material is chopped, intensively mixed, and compressed in the second barrel section 432, the material is heated by work energy. As the organic material traverses the second barrel section 432, it is heated to about 400 degrees F. Although the organic material is dried prior to input into the machine 400, it still typically includes residual moisture. The work energy heating in the second barrel section 432 is sufficient to drive off moisture as steam in the second barrel section 432. The helical and reverse helical designs in the dual screws 424 of the second barrel section 432 cause the organic material to become so highly compressed at the downstream end of the second barrel section 432 that a vapor block is formed. Therefore, the emitted steam is forced back upstream into the first barrel section 428. The steam is released as the first vented gas 466 through a first opening 454 in the chassis 420. A first duct 452 vents this steam 466, which may be routed to a heat recovery process.

Immediately downstream of the second barrel section 432 is a third barrel section 436. Here, the dual screws 424 return to a helical advancing screw design as in the first barrel section 428. As a result, the organic material advances more rapidly and is, therefore, decompressed. By allowing the material to "relax," it does not flow out of a second opening 458 in the chassis 420. Immediately downstream of the third barrel section 436 is a fourth barrel section 440. The dual screws 424 transition to helical screw sections of decreased pitch such that the organic material begins to recompress. The dual screws 424 then transition to, for example, radially abutting paddles that are progressively axially angularly out of phase or offset to the screw shaft. As a result, the organic material is further chopped, densified, intensively mixed, and compressed. By this point in the process, the organic material typically takes on a dark brown color and reaches a temperature in excess of 450 degrees F.

At the downstream end of the fourth barrel section 440, the dual screws 424 abruptly transition to reverse hand such that the forward flowing organic material meets itself in reverse flow. As a result, the material is effectively worked against itself to significantly increase the work energy input and to highly compress the material. The material is heated sufficiently to drive off lighter volatiles (hydrocarbons). However, with the organic material so highly compressed, another vapor block is formed at the downstream end of the fourth barrel section 440. Therefore, the lighter volatiles flow back upstream into the third barrel section 436. The lighter volatiles are released, as the second vented gas 470, through the second opening 456 in the chassis 420. A second duct 456 vents the second gas 470, which may be combusted, to provide energy to drive the dual screws, for example, or condensed for other uses.

Immediately downstream of the fourth barrel section 440 is a fifth barrel section 444. Here, the dual screws 424 return to a helical advancing screw design as in the first and third barrel sections 428 and 436. As a result, the organic material is again briefly decompressed to prevent out flow at a third opening 462 in the chassis 420. Immediately downstream of the fifth barrel section 444 is a sixth barrel section 448. The dual screws 424 again transition to helical screw sections of decreased pitch to cause recompression and heating. The dual screws 424 then transition, for example, to reverse hand to input significant work energy and highly compress the material. The material is heated sufficiently to drive off heavy volatiles (hydrocarbons). Another vapor block forms at the downstream end of the sixth barrel section 448 and forces the heavy volatiles back upstream into the fifth barrel section 444. The heavy volatiles are released, as the third vented gas 474, through the third opening 462 in the chassis 420. A third duct 460 vents the third gas 470, which may be routed to a combustion chamber. At the end of the sixth barrel section 448, the organic material reaches a temperature of about 600 degree F. At this point, the organic material is completely black and bears a charcoal-like appearance. The oxygen-free environment prevents the material, converted now to char, from igniting. A final cooling process is typically performed before the char is removed.

As described above, the carbonizing machine 400 is specifically designed to prevent outflow of the solid organic material at the first, second, and third openings 454, 458, and 462. However, two types of problems are found to occur in the gas openings 454, 458, and 462 and the gas ducts 452, 456, and 460. First, the incoming organic material is very dry and not very dense. It is therefore commonly called fluff. It is found that steam backflow from the second barrel 432 can carry some of the organic material fluff up the first opening 454 along with the steam 466. The fluff then deposits on the sidewalls of the first opening 454 or the first duct 452. The deposited fluff is a brownish, fluffy layer that can obstruct the first opening 454 and first duct 452 if not removed.

Second, as described above, the lighter and heavy volatile oils are released from the second opening 458 and the third opening 462, respectively, as the second gas 470 and third gas 474. The lighter volatiles are typically heated to between about 380 degrees and 400 degrees F. The heavy volatiles are typically heated to between about 520 degrees and 540 degrees F. The ambient temperature surrounding the machine 400 and the second and third ducts 456 and 460 is much lower. It is found that a portion of the gases 470 and 474 condenses on the sidewalls of the second and third openings 458 and 462 and on the second and third ducts 456 and 460. When the volatiles condense on the sidewalls of the openings and the ducts, any entrained particulate matter (such as the finely ground organic material) will easily stick to the sidewalls. As a result, the condensed lighter volatile matter forms a black, crusty layer. The condensed heavy volatile forms a black grease. Either deposit can obstruct the second or third opening 458 and 462 and second or third duct 456 and 460 if not removed.

Referring now to FIG. 18, a top view of the exemplary carbonizing machine 400 is shown. Portions of the dual screws 424' and 424" may be seen in this illustration. The dual screws 424' and 424" run the length of the machine 400. The hopper 450 is located over the dual screws 424' and 424" so that inputted organic material is captured and then transferred downstream by the screws. The first vent 452 is located over the dual screws 424' and 424" toward the end of the first barrel section. The second vent 456 is located over the dual screws 424' and 424" in the third barrel section. The third vent 460 is located over the dual screws 424' and 424" in the fifth barrel section.

Referring now to FIG. 19, a cross-sectional view of a carbonizing machine 414 shows the material deposition problem as found in the prior art. An opening 484 is positioned to release gas 486 from a barrel. However, material 480 is deposited on the sidewalls of the opening 484 in the chassis 420 or on the duct 482. This deposited material 480 may be the organic material fluff carried by released steam, as in the first opening of the carbonizing machine 400 of FIGS. 17 and 18, or condensed volatile and particulate matter, as in the second and third openings of the carbonizing machine 400 of FIGS. 17 and 18. Preventing the buildup of deposited material 480 is a pressing and unmet need in the art.

BRIEF DESCRIPTION OF THE DRAWINGS

The present invention and the corresponding advantages and features provided thereby will be best understood and appreciated upon review of the following detailed description of the invention, taken in conjunction with the following drawings, where like numerals represent like elements, in which.

DETAILED DESCRIPTION OF THE INVENTION

Figure 1:
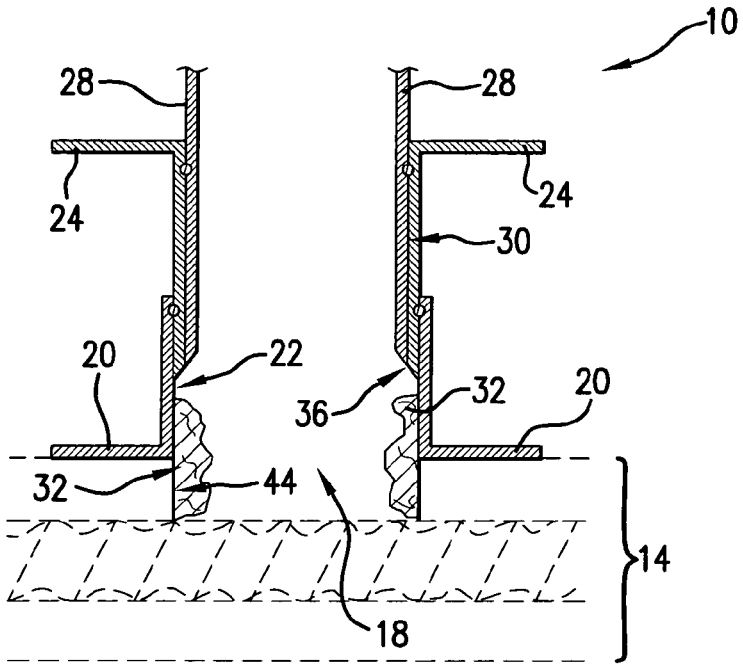
FIG. 1 is a cross-sectional view of an exemplary vent scraping apparatus for a carbonizing machine in accordance with one embodiment of the invention.

The present invention provides a vent scraping apparatus for a carbonizing machine. In one embodiment, the vent scraping apparatus includes a mount fixably attached to a carbonizing machine at an opening in the carbonizing machine. A duct is fixably attached within the mount. The duct conducts gas vented from the carbonizing machine. A scraper is movably attached between the mount and the duct. The scraper slides between an inner surface of the mount and an outer surface of the duct. The scraper includes a leading edge for scraping an inner surface of the carbonizing machine opening as the scraper is extended.

In another embodiment, the vent scraping apparatus includes a duct with a proximal end and a distal end. The duct conducts gas vented from the carbonizing machine. The proximal end is fixably attached to the carbonizing machine at an opening in the carbonizing machine. A wiping block is fixably attached to a distal end of the duct. A scraper is movably attached between the duct and the wiping block. The scraper slides between an inner surface of the duct and an outer surface of the wiping block. The scraper includes a leading edge for scraping an inner surface of the carbonizing machine opening as the scraper is extended.

In another embodiment, a carbonizing apparatus includes dual screws rotatably fixed within a plurality of barrels. The dual screws convert inputted organic waste material to outputted char via the impartation of work energy under adiabatic conditions. At least one barrel includes a vent. The vent includes a mount fixably attached to a barrel at an opening in the barrel, a duct fixably attached within the mount, and a scraper movably attached between the mount and the duct. The duct conducts gas vented from the barrel opening. The scraper is movably attached between the mount and the duct. The scraper slides between an inner surface of the mount and an outer surface of the duct. The scraper includes a leading edge for scraping an inner surface of the barrel opening when the scraper is extended.

In another embodiment, a carbonizing apparatus includes dual screws rotatably fixed within a plurality of barrels. The dual screws convert inputted organic waste material to outputted char via the impartation of work energy under adiabatic conditions. At least one barrel includes a vent. The vent includes a duct with a proximal end and a distal end, a wiping block fixably attached to the duct distal end, and a scraper movably attached between the duct and the wiping block. The duct conducts gas from the barrel. The scraper includes a leading edge for scraping an inner surface of the barrel opening as the scraper is extended.

The apparatus of the present invention yields several novel and unexpected advantages over the prior art. First, the scraping apparatus solves the problem of deposited material clogging a carbonizing machine gas opening. Second, the scraping apparatus is also effective for removing deposited material for duct work. Third, the scraping apparatus is self-cleaning. Fourth, the scraping apparatus may be easily integrated with a motor or other drive system to facilitate the performance of automatic and periodic scrapes without human intervention. Fifth, the scraping apparatus may be activated without interrupting the normal operation of the carbonizing machine or the release of gas. Seven, the scraping apparatus may be used with either vertical or horizontal duct work designs. Other advantages will be recognized by those of ordinary skill in the art.

Referring now to FIG. 1 an exemplary vent scraping apparatus 10, in accordance with one embodiment of the invention, is shown in cross-sectional view. The vent scraping apparatus 10 includes a mount 20 fixably attached to a carbonizing machine 14 at an opening 18 in the carbonizing machine. A duct 28 is fixably attached within the mount 20. The duct 28 is suitable for conducting gas vented from the carbonizing machine. A scraper 24 is movably attached between the mount 20 and the duct 28. More particularly, the scraper 24 slides between an inner surface 22 of the mount 20 and an inner surface 30 of the duct 28. The scraper 24 includes a leading edge 36 for scraping an inner surface 44 of the carbonizing machine opening 18 as the scraper is extended.

The mount 20 may be formed of a material capable of withstanding the temperature and environmental exposure of the application. The mount preferably is formed of metal, and more preferably of carbon steel. The mount may be attached to the chassis of the carbonizing machine 14 by any method known in the art such as, but not limited to, bolting and welding. The inner surface 22 of the mount 20 is aligned to the inner surface 44 of the carbonizing machine opening 18. This allows the scraper 24 to scrape both inner surfaces 22 and 44. The mount 20 may further include a seal, not shown, between the mount and the carbonizing machine 14 to prevent gas escape at the mount-chassis interface.

The duct 28 may be formed of a material capable of withstanding the temperature and environmental exposure of the application. The duct preferably is formed of metal, and more preferably of carbon steel. The duct 28 is not directly attached to the mount 20 due to the intervening presence of the scraper 24. The duct 28 is therefore preferably supported by attachment to the building as is well-known in the art.

The scraper 24 may be formed of a material capable of withstanding the temperature and environmental exposure of the application. Further, the scraper 24 material must be of sufficient working strength (1) to maintain its shape as it is moved between the mount 20 and the duct 28 and (2) to maintain an edge 36 for scraping and removing deposits inside the machine opening 18 and mount 20 over many cycles of extension and retraction. The scraper 24 preferably is formed of metal, and more preferably of carbon steel. The scraper 24 has a leading edge 36 oriented along the inside surface 22 of the mount and the inside surface 44 of the carbonizing machine opening 18.

Figure 8:
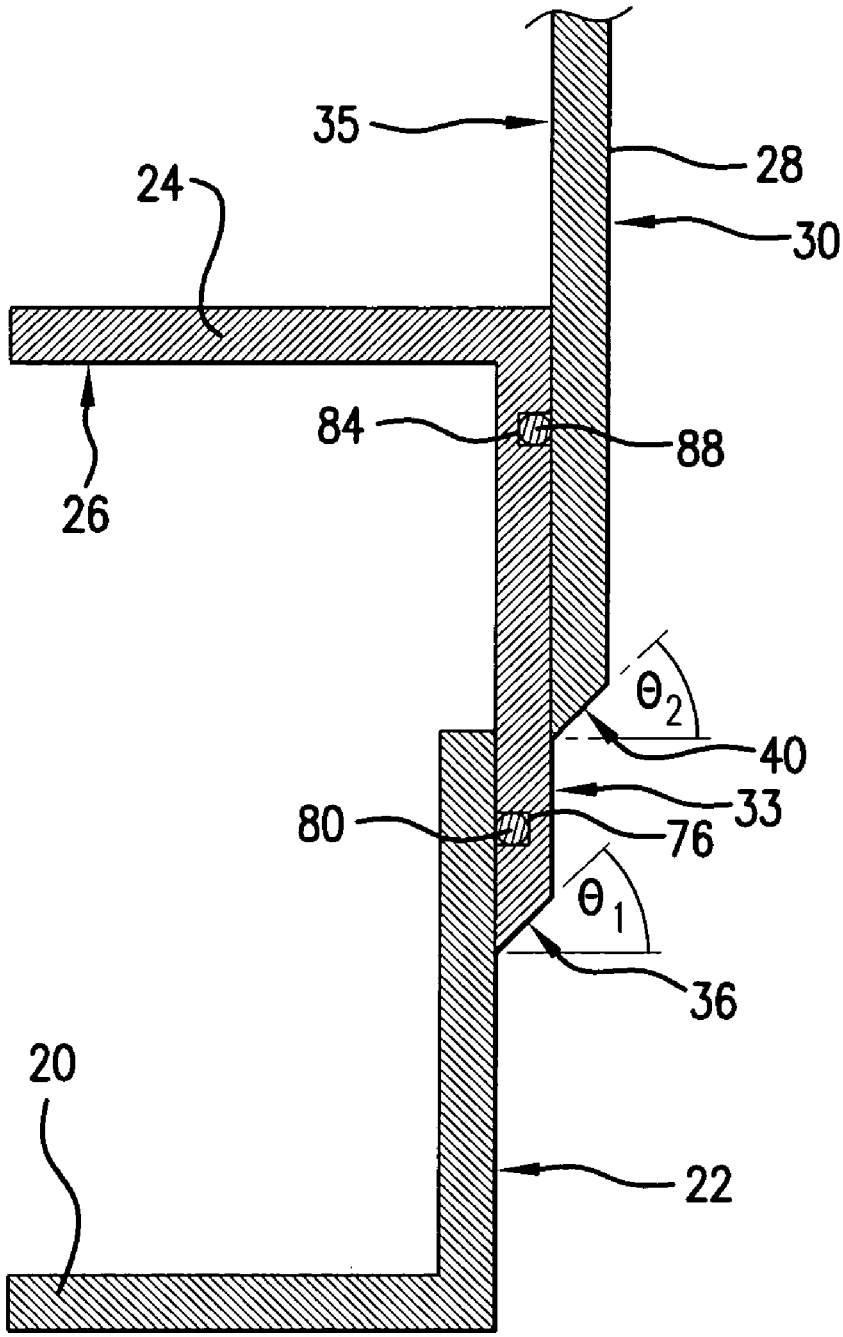
FIG. 8 is a cross-sectional view of a portion of an exemplary vent scraping apparatus in accordance with one embodiment of the invention.

Referring now to FIG. 8, the vent scraping apparatus is shown in a partial cross-section, apart from the carbonizing machine. Only one side (the left side) of the vent scraping apparatus of FIG. 1 is shown. Referring again to FIG. 8, the leading edge 36 of the scraper 24 may be any acute angle $\theta_1$, greater than 0 degrees and up to 90 degrees. More preferably the leading edge 36 of the scraper 24 has an angle of about 45 degrees to provide optimal scraping strength while optimizing the ability of to clean away scrapings via the duct 28.

The duct 24 also has a leading edge 40 oriented along the inside surface 33 of the scraper 24. The leading edge 40 of the duct 24 may be any acute angle $\theta_2$, greater than 0 degrees and up to 90 degrees. More preferably the leading edge 36 of the scraper 24 has an angle of about 45 degrees to provide optimal scraping strength while optimizing the ability of to clean away scrapings from the inner surface 33 of the scraper 24.

The vent scraping apparatus may further include a first seal 80 between the scraper 24 and the inner surface 22 of the mount 20. If used, the first seal 80 prevents gas leakage between the scraper 24 and the mount 20. The first seal 80 may be partially recessed in a slot 76 in the scraper 24. Alternatively, a first seal may be partially recessed in a slot in the mount 20, not shown. The first seal 80 may be formed of a flexible material capable of withstanding the temperature and environmental conditions within the carbonizing vent. For example, the first seal 80 may be made of rubber or other suitable materials, as is known in the art.

The vent scraping apparatus may further include a second seal 88 between the scraper 24 and the outer surface 35 of the duct 28. If used, the second seal 88 prevents gas leakage between the scraper 24 and the duct 20. The second seal 88 may be partially recessed in a slot 84 in the scraper 24. Alternatively, the second seal may be partially recessed in a slot in the duct 28, not shown. The second seal 88 may be formed of a flexible material capable of withstanding the temperature and environmental conditions within the carbonizing vent. For example, the second seal 88 may be made of rubber or other suitable materials, as is known in the art.

The scraper 24 may further include a flange 26. The flange 26 and the rest of the scraper 24 preferably are formed of a single piece of material, such as carbon steel. However, the flange 26 may be a separate piece of material attached to the scraper 24 by welding or bolting or by any other method known in the art. The flange 26 forms a lever, or handle, for moving the scraper 24 up and down with respect to the mount 20. When the scraper 24 is moved to its highest upward position—where it most overlaps the duct 28—it is in its retracted position. When the scraper 24 is moved to its lowest downward position—where it most overlaps the mount—it is in its extended position. The flange 26 therefore allows a mechanically advantageous attachment to the scraper for retraction and extension. Preferably, the flange is further attached to a motor or other drive mechanism as is further described below.

Figure 2:
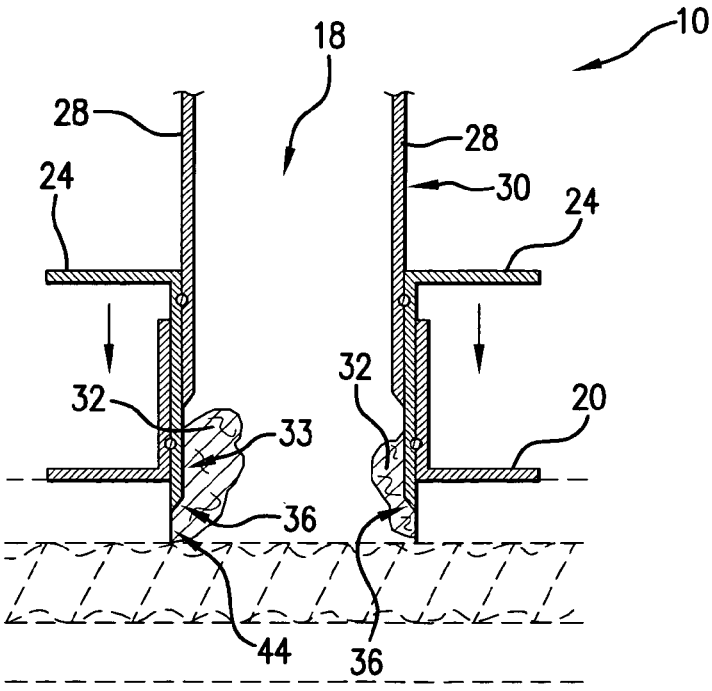
FIGS. 2 and 3 are cross-sectional views showing the operation of an exemplary vent scraping apparatus in accordance with one embodiment of the invention.

Referring again to FIG. 1, the scraper 24 is shown in its retracted position. In this position, the inner surface 44 of the carbonizing machine opening 18 and the inner surface 22 of the mount 20 are to exposed gas vented though the opening 18. If the gas contains fluff or volatile gases and particulate matter, as discussed above, then material 32 will deposit on the expose inner surfaces 44 and 22. Referring now to FIG. 2, the exemplary vent scraping apparatus 10 is again shown in cross-sectional view. Here, the scraper 24 is extended downwards into the opening 18. As the scraper 24 extends, its leading edge 36 scrapes against the inner surface 22 of the mount 20 and the inner surface 44 of the machine opening 18. As it extends, the scraper 24 scrapes away the deposited material 32. Some of the scraped material 32 falls from the scraper 24 into the barrel of the machine 14. The rest of the scraped material 32 is driven onto and retained by the inner surface 33 of the scraper 24.

Figure 3:
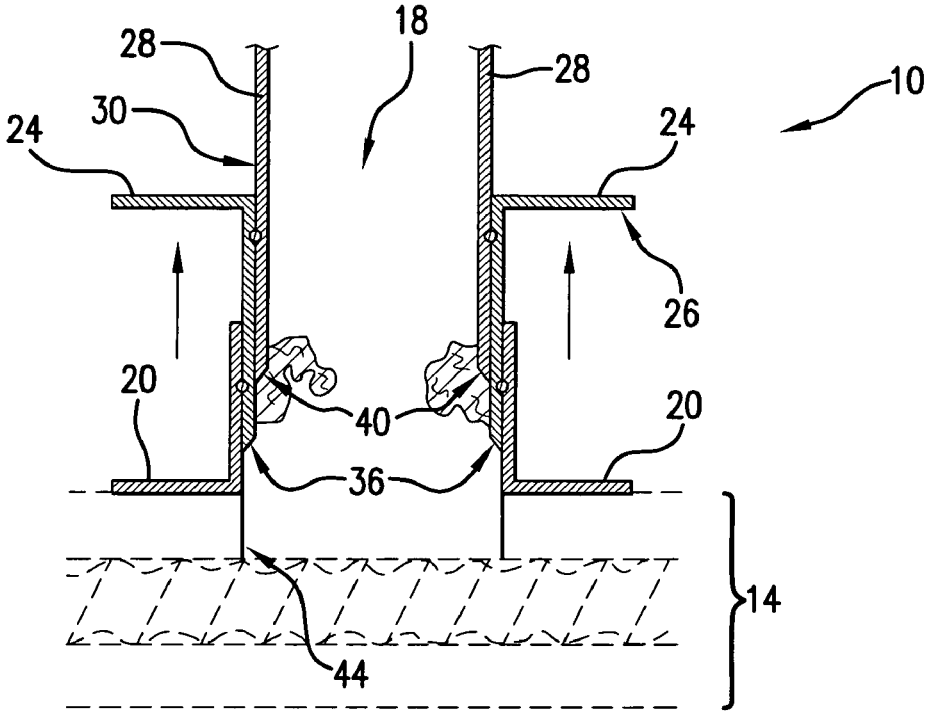

Referring now to FIG. 3, the exemplary vent scraping apparatus 10 is again shown in cross-sectional view. Here, the scraper 24 is retracted upwards towards the duct 28. As the scraper 24 retracts, the leading edge 40 of the duct 28 cleans away the scraped material 32 retained on the scraper 24. This material 32 falls back into the barrel of the machine 14.

Figure 4:
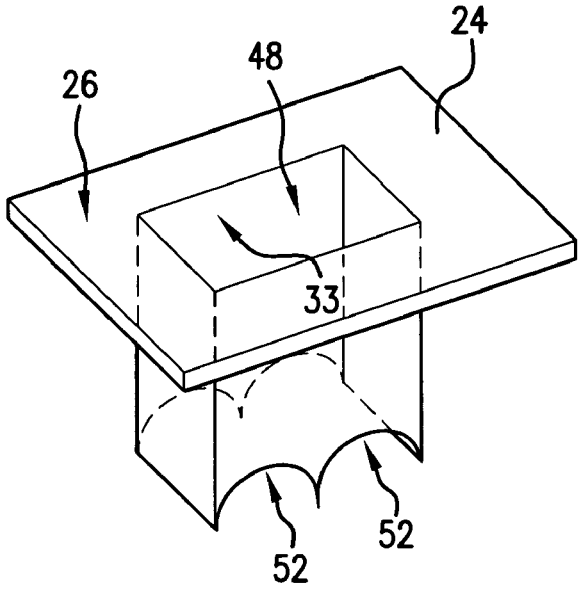
FIG. 4 is an isometric view of an exemplary scraper for a vent scraping apparatus in accordance with one embodiment of the invention.
Figure 18:
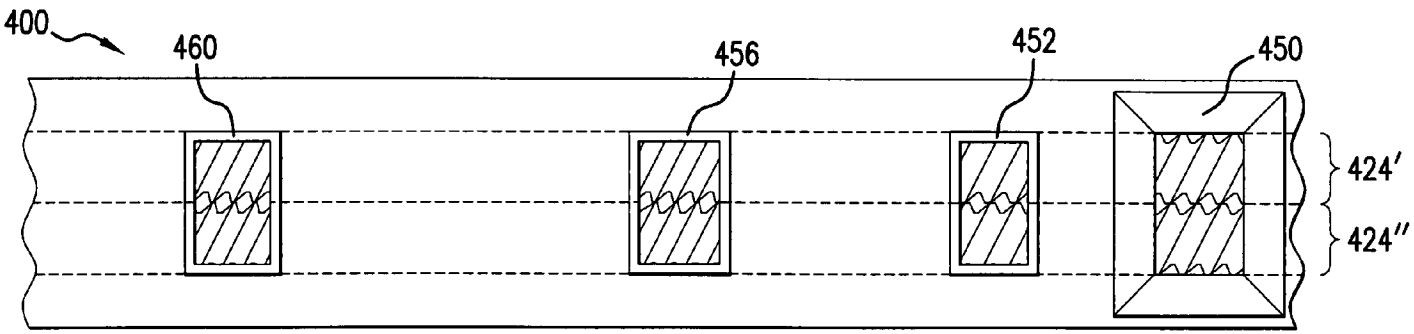
FIG. 18 PRIOR ART
FIG. 18 is a top view of the prior art carbonizing machine.
Figure 19:
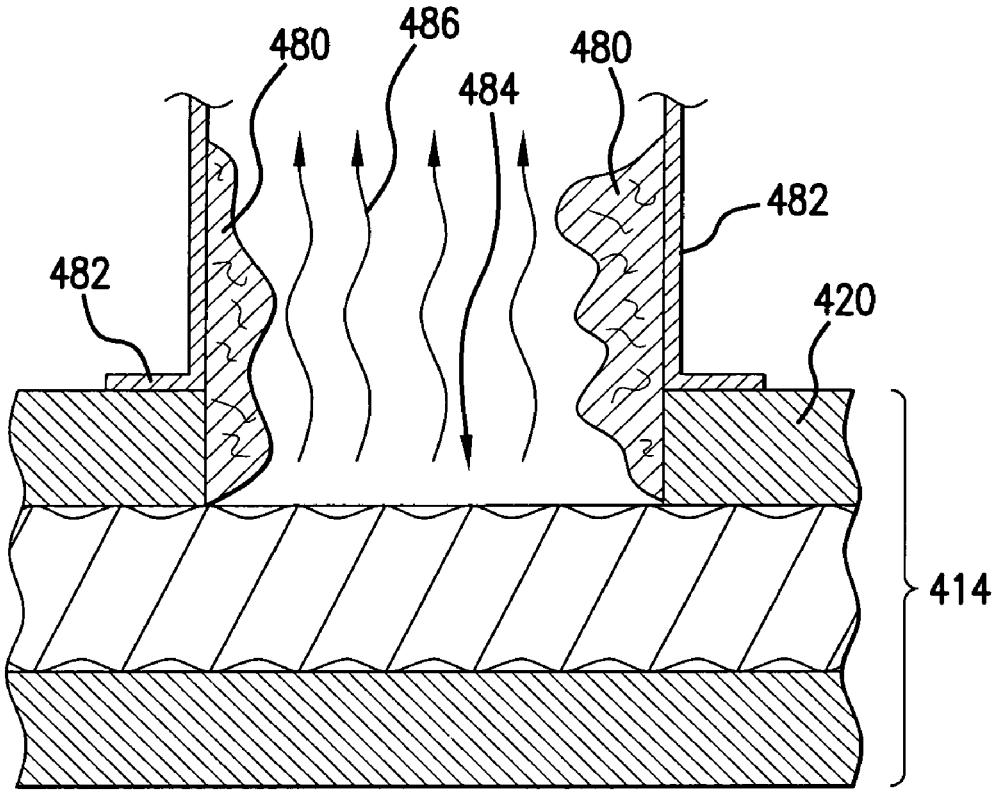
FIG. 19 PRIOR ART
FIG. 19 is a cross-sectional view of a carbonizing machine showing the deposition problem of the prior art.

Referring now to FIG. 4, the exemplary scraper 24 of the vent scraping apparatus is shown in isometric view. Several important features of the scraper 24 are shown. First, the flange 26 is shown. The flange 26 appears as a lever at a right angle to the scraper 24. However, the flange 26 could be any angle consistent with the purpose of providing a mechanical connection for driving the scraper up and down. Second, material from the carbonizing machine may deposit on any side of the barrel opening or the mount. The scraper 24 must be capable of scraping all the inner surfaces of the opening and the mount. Therefore, the scraper 24 preferably has a closed polygonal cross-section, as shown. More preferably, the scraper 24 has four sides, each corresponding to an inner surface of the mount and the duct. Third, the scraper 24 is preferably hollow 48 so that the vented gas from the carbonizing machine can flow through the scraper 24. Fourth, the leading edges of the scraper 24 are shaped 52 to accommodate the dual screws of the carbonizing machine. In particular, the dual screws run the length of the carbonizing machine through a sequence of barrels. As shown in FIG. 18, each vent 452, 456, and 460 of the exemplary prior art carbonizing machine is placed over the dual screws 424' and 424".

Referring again to FIG. 4, it is advantageous for the scraper 24 to be capable of extending downward through the opening of the carbonizing machine to scrape the inner surfaces of that opening. To facilitate scraping the inner surface of the barrel opening as deeply as possible, the sidewalls of the scraper are preferably cutaway 52 to conform to the profile of and to avoid contact with the dual screws. The scraper 24 does not interfere with either the flow of released gas—since it is hollow—or the operation of the dual screws—since the leading edge is shaped 52 to avoid contacting the dual screws. Therefore, the scraping apparatus may be used to periodically remove deposited material while the carbonizing machine is in normal operation.

Figure 5A:
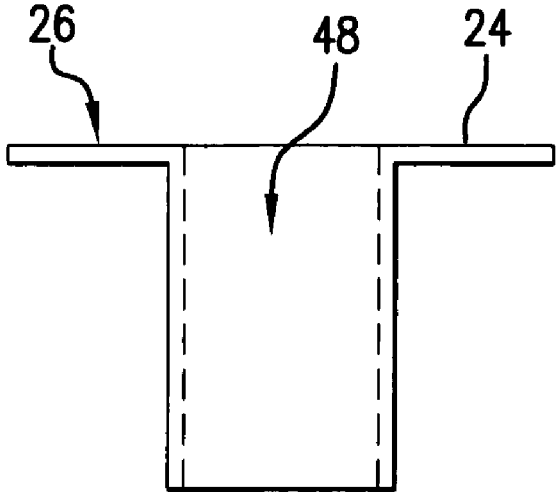
FIGS. 5A and 5B are side views, from different directions, of an exemplary scraper for a vent scraping apparatus in accordance with one embodiment of the invention.
Figure 5B:
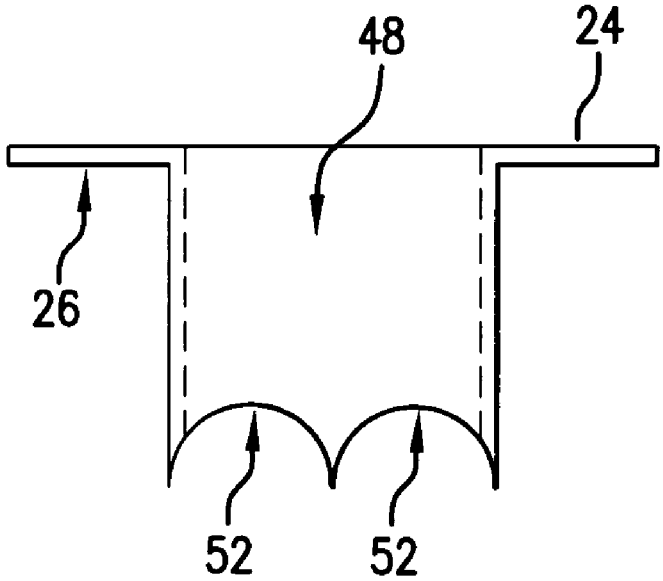

Referring now to FIGS. 5A and 5B, side views of the exemplary scraper 24 are shown. Referring particularly to FIG. 5A, a side view of the scraper 24 is shown for a side running parallel with the direction of the dual screws. The flange 26 is shown. The scraper 24 is hollow, like the duct, so that vented gas from the carbonizing machine may be conducted through the scraper. Referring particularly to FIG. 5B, a side view of the scraper 24 is shown for a side running perpendicular to the direction of the dual screws. The shape 52 of the leading edge of the scraper 24 conforms to and avoids contact with the dual screws with the scraper 24 is fully extended into the carbonizing machine opening.

Figure 7:
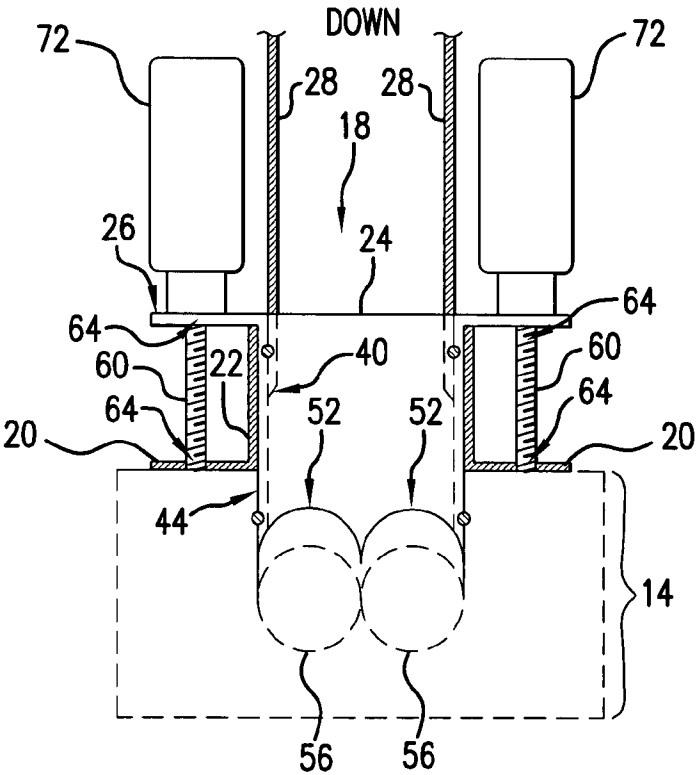
FIGS. 6 and 7 are partially cross-sectioned views of an exemplary vent scraping apparatus in accordance with one embodiment of the invention.
Figure 6:
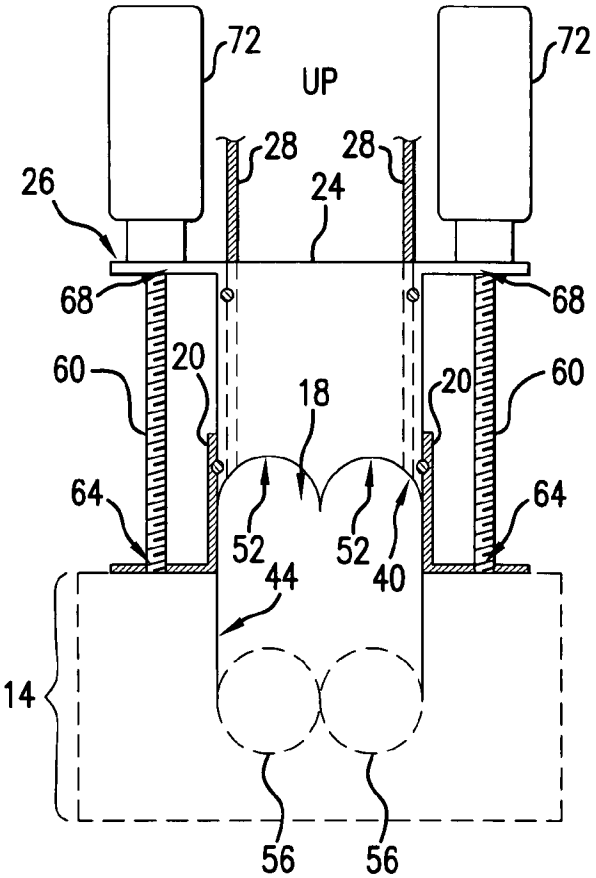

Referring now to FIGS. 6 and 7, partially cross-sectioned views of the exemplary vent scraping apparatus are shown. The exemplary carbonizing machine 14 is shown at a cross-section perpendicular to the longitudinal direction of the dual screws 56. However, the cross-section is taken to show how the scraper sidewall perpendicular to the dual screws 56 is shaped 52 on its leading edge to conform to the profile of and to avoid contact with the dual screws 56. In addition, the flange 26 of the scraper 24 is coupled to two mechanical drives, each including a motor 72 and a shaft 60. The mechanical drives provide power to extend and retract the scraper 24 as it slides between the mount 20 and duct 28. For example, the motors 72 may be electric servo-motors and the shafts 60 may be threaded. The servo-motors 72 are capable of turning on the threaded shafts 60, in either direction, to thereby move the motors 72 up or down the shafts 60. The other ends of the shafts 60 are attached to the mounts 20. As the motor 72 moves, the scraper 24 is forced to move in the same direction. The motors 72 and shafts 60 are attached to the flanges 26 by, for example, bolting or welding, however, any method known to the art may by used. The shafts 60 are attached to the mounts 20 by, for example, bolting or welding, however, any method known in the art may be used. The motors 72 and shafts 60 may be replaced by a single motor 72 with multiple shafts 60, or by a single motor 72 and shaft 60. Other drive mechanisms may be used, such as pneumatic drives, power take-offs, (where motor energy is taken from a motor performing an entirely different function), or other drives as known in the art.

FIG. 6 shows the vent scraping apparatus with the scraper 24 in the UP, or retracted, position. In this position, the inner surface 44 of the barrel opening 18 is exposed to gas vented from the barrel. The inner surface 22 of the mounts 20 are also exposed. Referring again to FIG. 7, the scraper 24 is shown in the DOWN, or extended, position. The scraper 24 scrapes past the mount inner surfaces 22 and the barrel inner surfaces 44 to remove any deposited material. The scraper 24 is shaped 52 so it can contact the maximum inner surface of the barrel without contacting the dual screws 56. Referring again to FIG. 6, when the scraper 24 is retracted, the leading edge 40 of the duct 28 removes the scraped material retained on the scraper 24.

Figure 9A:
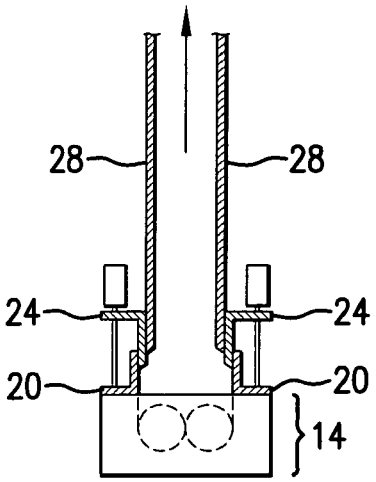
FIGS. 9A and 9B are partially cross-sectional views of an exemplary vent scraping apparatus in accordance with one embodiment of the invention.
Figure 9B:
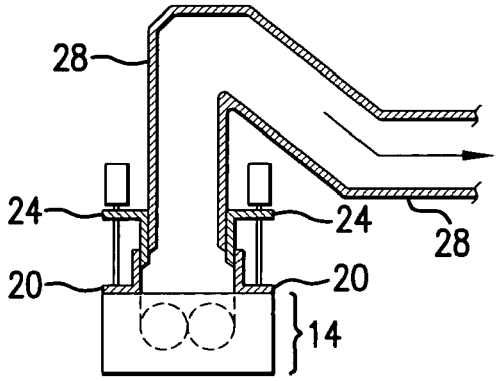

Referring now to FIGS. 9A and 9B, the vent scraping apparatus of this embodiment allows the duct 28 to be configured to conduct released gas vertically away from the carbonizing machine 14, as shown in FIG. 9A, or horizontally, as shown in FIG. 9B.

Figure 10:
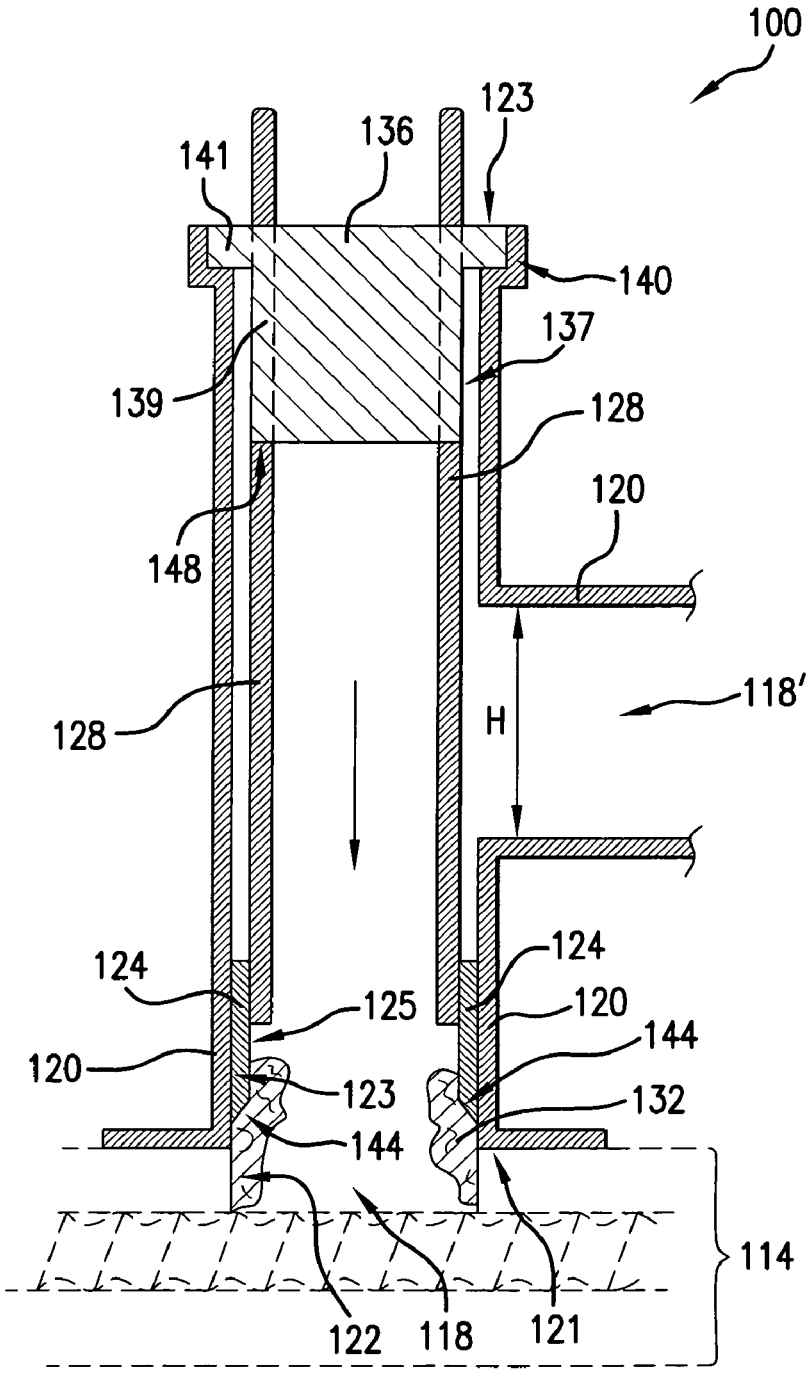
FIGS. 10 and 11 are cross-sectional views of an exemplary vent scraping apparatus in accordance another embodiment of the invention.
Figure 11:
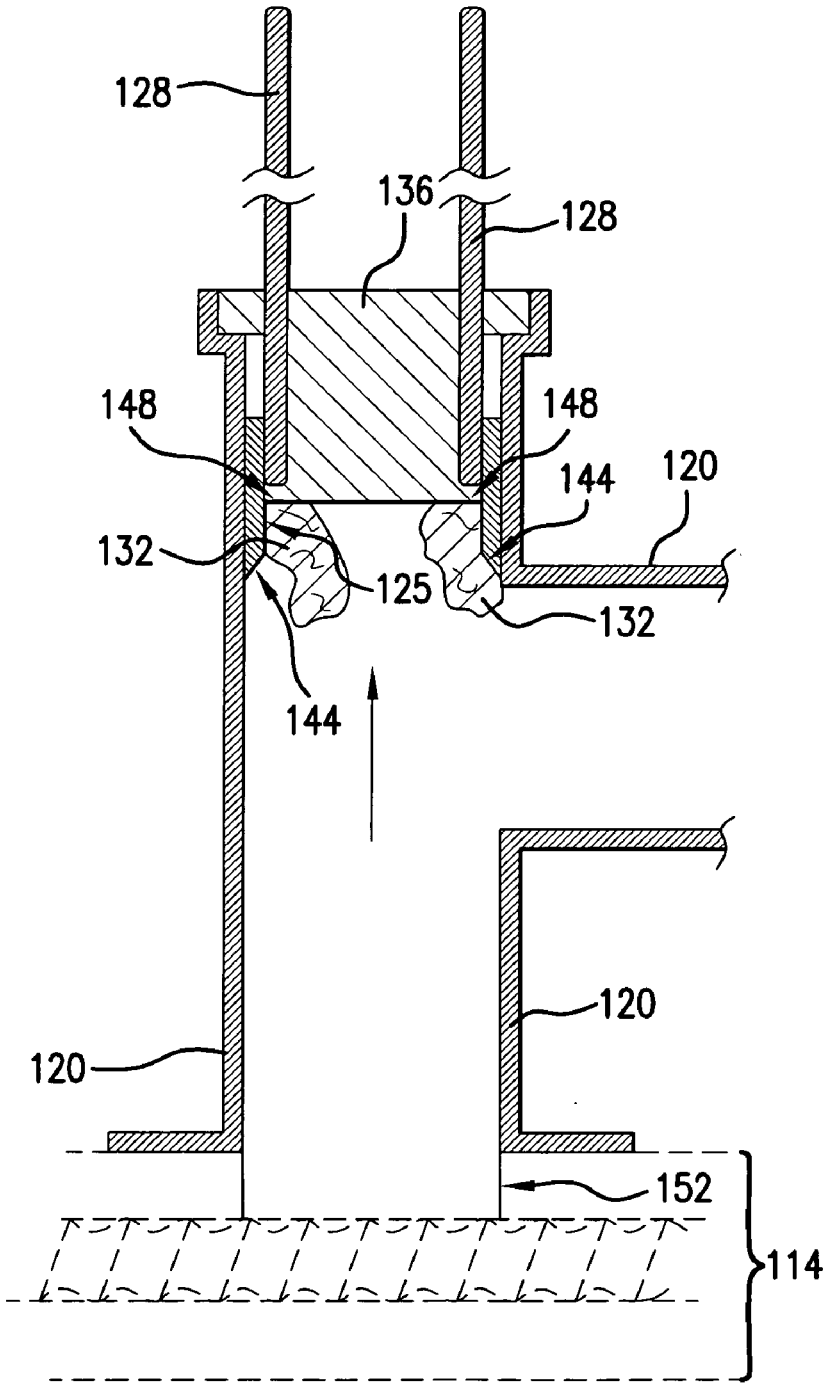

Referring now to FIGS. 10 and 11, another embodiment of a vent scraping apparatus 100 is shown in cross-sectional view. Referring particularly to FIG. 10, the vent scraping apparatus 100 includes a duct 120 including a proximal end 121 and a distal end 123. The duct 120 conducts gas vented from the carbonizing machine 114. The proximal end 121 is fixably attached to a carbonizing machine 114 at an opening 118 in the carbonizing machine 114. A wiping block 136 is fixably attached to the duct distal end 123. A scraper 124 is movably attached between the duct 120 and the wiping block 136. The scraper 124 slides between an inner surface 123 of the duct 120 and an outer surface 137 of the wiping block 136. The scraper 124 includes a leading edge 144 for scraping an inner surface 122 of the carbonizing machine opening 118 as the scraper 124 is extended.

The duct 120 may be formed of a material capable of withstanding the temperature and environmental exposure of the application. The duct 120 preferably is formed of metal, and more preferably of carbon steel. The proximal end 121 of the duct 120 may be attached to the carbonizing machine 114 by any method known in the art such as, but not limited to, bolting and welding. The inner surface 123 of the duct 120 is aligned to the inner surface 122 of the carbonizing machine opening 118. This allows the scraper 124 to scrape both inner surfaces 123 and 122. The duct 120 may further include a seal, not shown, between the duct 120 and the carbonizing machine 114 to prevent gas escape at the duct-chassis interface. The distal end 123 duct 120 is preferably supported by attachment to the building as is well-known in the art.

The scraper 124 may be formed of a material capable of withstanding the temperature and environmental exposure of the application. Further, the scraper 124 material must be of sufficient working strength (1) to maintain its shape as it is moved between the duct 120 and the wiper block 136 and (2) to maintain an edge 144 for scraping and removing deposits over many cycles of extension and retraction. The scraper 124 preferably is formed of metal, and more preferably of carbon steel. The scraper 124 has a leading edge 144 oriented along the duct inside surface 123 and the barrel opening inside surface 122. As in the prior embodiment, the leading edge 144 of the scraper 124 may be any acute angle greater than 0 degrees and up to 90 degrees. More preferably, the leading edge 144 of the scraper 124 has an angle of about 45 degrees to provide optimal scraping strength while optimizing the ability of to clean away scrapings.

Figure 15:
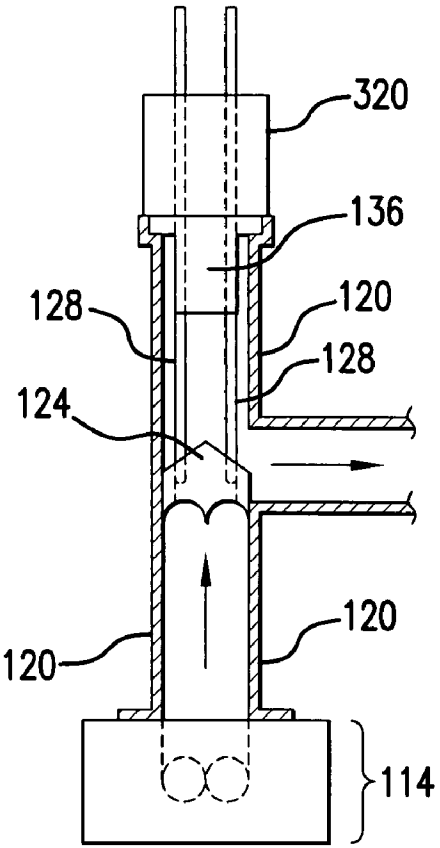
FIG. 15 is a partially cross-sectional view of an exemplary vent scraping apparatus in accordance with another embodiment of the invention.

The vent scraping apparatus 100 preferably further includes at least one support rod 128 fixably attached to the scraper 124. Here, two support rods 128 are used. The support rods 128 may be formed of a material capable of withstanding the temperature and environmental exposure of the application. The support rods 128 are preferably formed of metal, and more preferably of carbon steel. The support rods 128 are preferably attached to the scraper 124 by welding, however, any method known in the art may be used. The support rods 128 slide through slots 139 in the wiping block 136. The support rods 128 provide a means to extend and retract the scraper 124. The supports rods 128 are preferably further attached to a driving mechanism capable of moving the support rods 128 vertically. Referring now to FIG. 15, an exemplary embodiment of the vent scraping apparatus shows a drive mechanism 320, such as a servo motor, attached to the support rods 128 and anchored to the wiping block 136.

Figure 16:
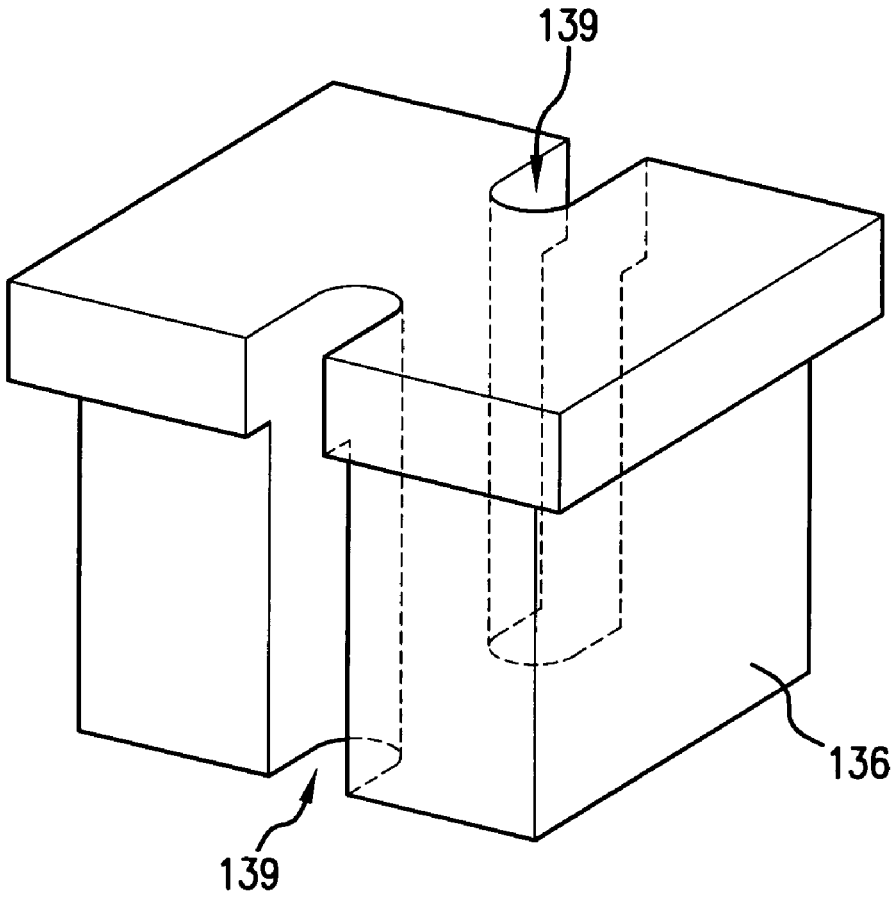
FIG. 16 is an isometric view of an exemplary wiping block for a vent scraping apparatus in accordance with several embodiments of the invention.
Figure 17:
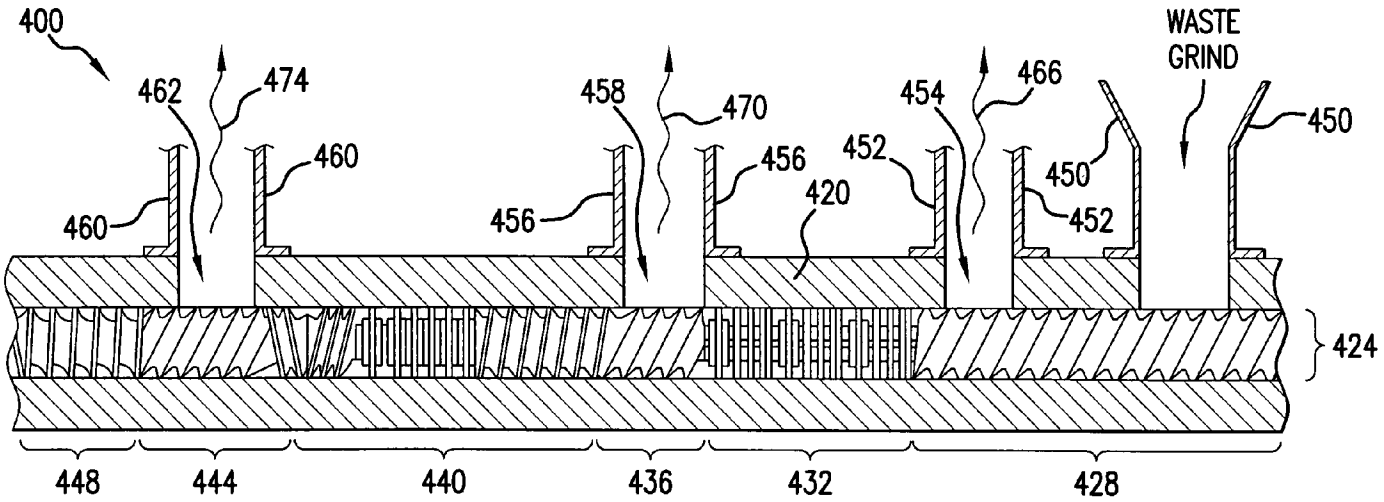
FIG. 17 PRIOR ART
FIG. 17 is a cross-sectional view of a prior art carbonizing machine.

Referring again to FIG. 10, the wiping block 136 is attached to the distal end 123 of the duct 120. The wiping block 136 is closed to block vented gases in the duct 120. Therefore, the duct 120 includes a side opening 118' to conduct vented gas away from the carbonizing machine 114. Preferably, the wiping block 136 is constructed of a solid material to provide strength and support for the support rods 128 that slide through the wiping block slots 139. The wiping block 136 may be formed of a material capable of withstanding the temperature and environmental exposure of the application. The wiping block 136 is preferably formed of metal, and more preferably of carbon steel. The wiping block 136 includes a leading edge 148 that contacts the inner surface 125 of the scraper 124 when the scraper is retracted, as shown in FIG. 11. The wiping block 136 is preferably attached to the distal end 123 of the duct 120 by welding; however, any method known in the art may be used. Preferably, the duct 120 includes a shelved corner 140 to retain the wiping block 136 while providing structural support for the weight of the wiping block 136 and support rods 128, scraper 124, and any mechanical drive (not shown) attached to the wiping block 136. Referring now to FIG. 16, an exemplary embodiment of the wiping block 136 is shown in isometric view. Slots 139 for the support rods are depicted.

Referring again to FIG. 10, the scraper 124 is extended downwards into the opening 118. As the scraper 124 extends, its leading edge 144 scrapes against the inner surface 123 of the duct 120 and the inner surface 122 of the machine opening 118. The scraper 124 scrapes away any deposited material 132. Some of the scraped material 132 falls from the scraper 124 into the barrel of the machine 114. The rest of the scraped material 132 is driven onto and retained by the inner surface 125 of the scraper 124. Referring again to FIG. 11, the scraper 124 is shown in its retracted position. The leading edge 148 of the wiping block 136 scrapes the scraper inner surface 125 as the scraper 124 moves upward. The wiping block 136 cleans the scraper 124 to remove any of the deposited material 132 retained on its inner surface 125. This material 132 falls back into the barrel.

Figure 12:
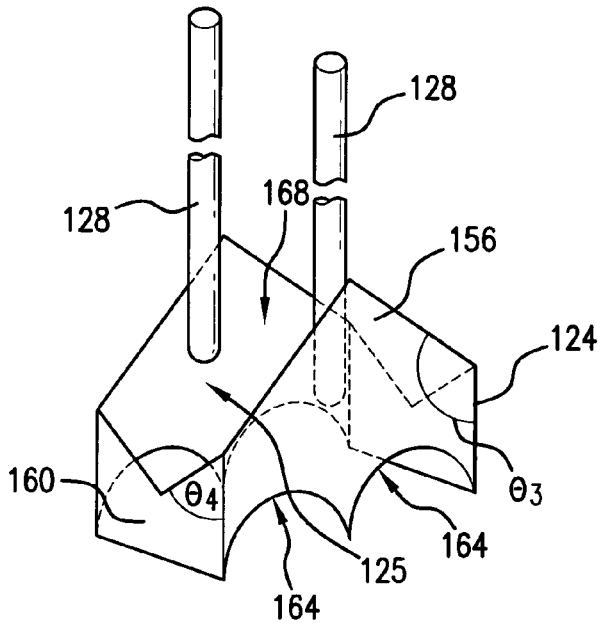
FIG. 12 is an isometric view of an exemplary scraper for a vent scraping apparatus in accordance with another embodiment of the invention.

Referring now to FIG. 12, an exemplary scraper 124 for this embodiment of the vent scraping apparatus is shown in isometric view. Several important features of the scraper 124 are shown. First, support rods 128 are attached to the inner surface 125 of the scraper 124. Second, material from the carbonizing machine may deposit on any side of the barrel opening or duct. To remove the deposited material, the scraper 124 must be capable of scraping all the inner surfaces of the opening and the duct. Therefore, the scraper 124 preferably has a closed polygonal cross-section, as shown. More preferably, the scraper 124 has four sides, each corresponding to an inner surface of the barrel and the duct. Third, the scraper 124 is preferably hollow 168 so that vented gas from the carbonizing machine can flow through the scraper 124.

Fourth, the leading edges of the scraper 124 are shaped 164 to accommodate the dual screws of the carbonizing machine. In particular, the dual screws run the length of the carbonizing machine through a sequence of barrels. As shown in FIG. 18, each vent 452, 456, and 460 of the exemplary prior art carbonizing machine is placed over the dual screws 424' and 424". Referring again to FIG. 12, it is advantageous for the scraper 124 to be capable of extending downward into the opening in the carbonizing machine to scrape the inner surfaces of that opening. To facilitate scraping the inner surface of the barrel opening as deeply as possible, the sidewalls of the scraper 124 are preferably cutaway 164 in the profile of the dual screws to avoid contact with the dual screws. The scraper 124 does not interfere with either the flow of released gas—since it is hollow—or the operation of the dual screws—since the leading edge is shaped 164 to avoid contacting the dual screws. Therefore, the scraping apparatus may be used to periodically remove deposited material while the carbonizing machine is in normal operation. Fifth, the sidewalls 156 and 160 of the scraper 124 have non-right angle corners $\theta_3$ and $\theta_4$. The non-right angle corners $\theta_3$ and $\theta_4$ prevent the scraper 124 from binding between the duct and the wiping block when retracted.

Sixth, referring again to FIG. 10, the presence of the closed wiping block 136 requires a side opening 118' in the duct 120 to conduct vented gas. The scraper 124 passes the side opening 118' during extension or retraction. The sidewalls of the scraper 124 must be made roughly the same width as the duct 120 to effectively scrape all of the potential deposits. However, if the scraper sidewall facing the duct side opening 118' is as tall as or taller than the height H of the opening 118', then the spacer 124 could shut off gas flow through the opening 118' as it passes. Referring again to FIG. 12, the exemplary scraper 124 will can only partially block the sidewall opening as it passes because (1) the scraper sidewall 160 is shorter than the height H of the duct side opening and (2) the scraper sidewall 160 is not rectangular.

Figure 13A:
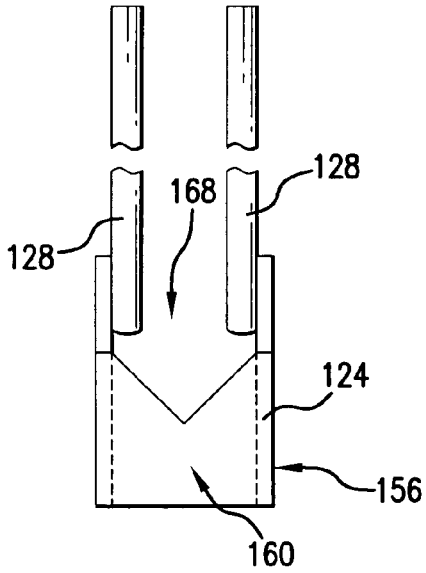
FIGS. 13A and 13B are side views, from different directions, of an exemplary scraper for a vent scraping apparatus in accordance with another embodiment of the invention.
Figure 13B:
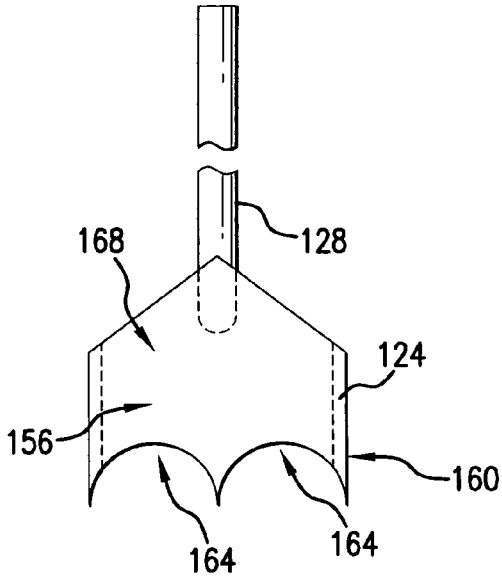

Referring now to FIGS. 13A and 13B, side views of the exemplary scraper 124 of this embodiment are shown. Referring particularly to FIG. 13A, a side view of the scraper 124 is shown for a side running parallel with the direction of the dual screws. The scraper 124 is hollow 168, like the duct, so that vented gas from the carbonizing machine may be conducted through the scraper. Referring particularly to FIG. 13B, a side view of the scraper 124 is shown for a side running perpendicular to the direction of the dual screws. The shape 164 of the leading edge of the scraper 124 conforms to and avoids contact with the dual screws when the scraper 124 is fully extended into the carbonizing machine opening.

Figure 14:
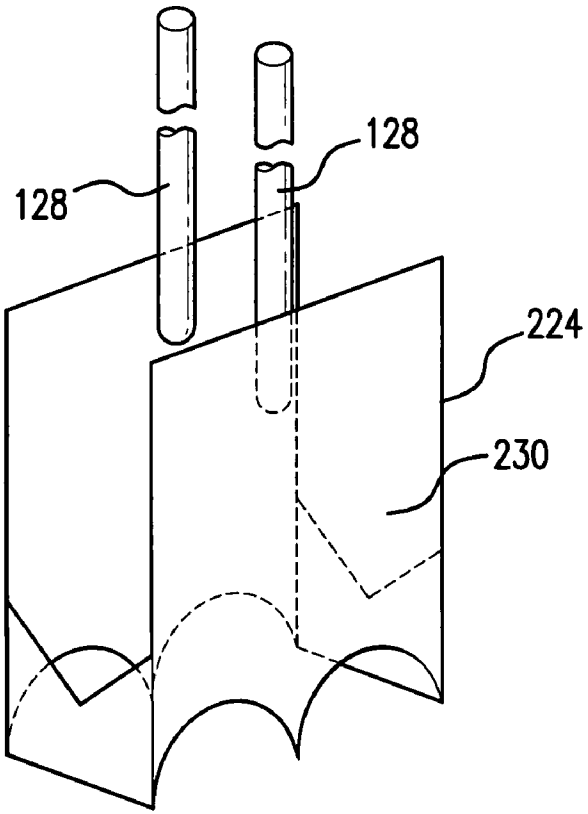
FIG. 14 is an isometric view of an exemplary scraper for a vent scraping apparatus in accordance with yet another embodiment of the invention.

Referring now to FIG. 14, an alternative embodiment of an exemplary scraper 224, for use in a scraper-wiping block apparatus, is shown in isometric view. This scraper 224 is identical to the scraper 124 shown in FIG. 12 except that the scraper sidewall 230 perpendicular to the longitudinal direction of the dual screws does not have non-right angled corners.

Referring now to FIG. 15, the vent scraping apparatus, based on the scraper-wiping block approach, requires the duct 128 to conduct released gas horizontally away from the carbonizing machine 114.

The above detailed description of the invention, and the examples described therein, has been presented for the purposes of illustration and description. While the principles of the invention have been described above in connection with a specific device, it is to be clearly understood that this description is made only by way of example and not as a limitation on the scope of the invention.

What is claimed is:

1. A vent scraping apparatus for a carbonizing machine, the apparatus comprising:

a mount fixably attached to a carbonizing machine at an opening on the carbonizing machine;

a duct fixably attached within the mount and operable to conduct gas vented from the carbonizing machine; and a scraper movably attached between the mount and the duct and operable to slide between an inner surface of the mount and an outer surface of the duct, wherein the scraper comprises a leading edge operable to scrape an inner surface of the carbonizing machine opening as the scraper is extended.

2. The apparatus of claim 1 wherein the duct further comprises a leading edge and is further operable to clean the scraper as the scraper is retracted.

3. The apparatus of claim 1 wherein the scraper is further operable to scrape the mount inner surface.

4. The apparatus of claim 1 wherein the scraper further comprises a closed polygonal shape and wherein the scraper is further operable to conduct the vented gas.

5. The apparatus of claim 1 wherein the scraper further comprises a flange operable for attaching a mechanical device.

6. The apparatus of claim 1 further comprising a motor mechanically coupled between the scraper and the mount and operable to extend and retract the scraper relative to the mount.

7. The apparatus of claim 1 wherein the scraper leading edge conforms to the profile of screws in the carbonizing machine.

8. The apparatus of claim 1 further comprising a first seal between the scraper and the mount and a second seal between the scraper and the duct.

9. A vent scraping apparatus for a carbonizing machine, the apparatus comprising:

a duct comprising a proximal end and a distal end and operable to conduct gas vented from a carbonizing machine, wherein the proximal end is fixably attached to the carbonizing machine at an opening on the carbonizing machine;

a wiping block fixably attached to the duct distal end; and a scraper movably attached between the duct and the wiping block and operable to slide between an inner surface of the duct and an outer surface of the wiping block, wherein the scraper comprises a leading edge operable to scrape an inner surface of the carbonizing machine opening as the scraper is extended.

10. The apparatus of claim 9 wherein the wiping block comprises a leading edge operable to clean the scraper as the scraper is retracted.

11. The apparatus of claim 9 wherein the scraper is further operable to scrape the duct inner surface.

12. The apparatus of claim 9 further comprising at least one support rod fixably attached to the scraper, wherein the wiping block comprises at least one slot, and wherein the support rod is operable to slide through the wiping block slot.

13. The apparatus of claim 9 further comprising a motor mechanically coupled between the scraper and the wiping block and operable to extend and to retract the scraper relative to the wiping block.

14. The apparatus of claim 9 wherein the scraper leading edge conforms to the profile of screws of the carbonizing apparatus.

15. The apparatus of claim 9 wherein the scraper further comprises a closed polygonal shape and wherein the scraper is further operable to conduct the vented gas.

16. The apparatus of claim 15 wherein the scraper further comprises sidewalls having non-right angle corners operable to prevent binding of the scraper between the duct and the wiping block.

17. The apparatus of claim 9 wherein the duct further comprises a side opening positioned between the proximal and distal ends, wherein the scraper further comprises a sidewall operable to cross the duct side opening, and wherein the scraper sidewall is shaped to only partially block the duct side opening.

18. A carbonizing apparatus comprising dual screws rotatably fixed within a plurality of barrels and operable to convert inputted organic waste material to outputted char via the impartation of work energy under adiabatic conditions, wherein at least one barrel comprises a vent, the vent comprising:

a mount fixably attached to the barrel at an opening in the barrel;

a duct fixably attached within the mount and operable to conduct gas vented from the barrel opening; and a scraper movably attached between the mount and the duct and operable to slide between an inner surface of the mount and an outer surface of the duct wherein the scraper comprises a leading edge operable to scrape an inner surface of the barrel opening when the scraper is extended.

19. The apparatus of claim 18 wherein the duct further comprises a leading edge operable to clean the scraper as the scraper is retracted.

20. The apparatus of claim 18 wherein the scraper is further operable to scrape the mount inner surface.

21. The apparatus of claim 18 wherein the scraper further comprises a closed polygonal shape and wherein the scraper is further operable to conduct vented gas.

22. The apparatus of claim 18 wherein the scraper further comprises a flange operable for attaching a mechanical device.

23. The apparatus of claim 18 further comprising a motor mechanically coupled between the scraper and the mount and operable to extend and retract the scraper relative to the mount.

24. The apparatus of claim 18 wherein the scraper leading edge conforms to the profile of the screws.

25. A carbonizing apparatus comprising dual screws rotatably fixed within a plurality of barrels and operable to convert inputted organic waste material to outputted char via the impartation of work energy under adiabatic conditions, wherein at least one barrel comprises a vent, the vent comprising:

a duct comprising a proximal end and a distal end and operable to conduct gas from the barrel, wherein the proximal end is fixably attached to the barrel at an opening in the barrel;

a wiping block fixably attached to the duct distal end; and a scraper movably attached between the duct and the wiping block and operable to slide between an inner surface of the duct and an outer surface of the wiping block wherein the scraper comprises a leading edge operable to scrape an inner surface of the barrel opening as the scraper is extended.

26. The apparatus of claim 25 wherein the wiping block comprises a leading edge operable to clean the scraper as the scraper is retracted.

27. The apparatus of claim 25 wherein the scraper is further operable to scrape the duct inner surface.

28. The apparatus of claim 25 further comprising at least one support rod fixably attached to the scraper, wherein the wiping block comprises at least one slot, and wherein the support rod is operable to slide through the wiping block slot.

29. The apparatus of claim 25 further comprising a motor mechanically coupled to the scraper and the wiping block and operable to extend and retract the scraper relative to the wiping block.

30. The apparatus of claim 25 wherein the leading edge of the scraper conforms to the profile of the screws.

31. The apparatus of claim 25 wherein the scraper further comprises a closed polygonal shape and wherein the scraper is further operable to conduct vented gas.

32. The apparatus of claim 31 the scraper further comprises sidewalls having non-right angle corners operable to prevent binding of the scraper between the duct and the wiping block.

33. The apparatus of claim 25 the duct further comprises a side opening positioned between the proximal and distal ends, wherein the scraper further comprises a sidewall operable to cross the duct side opening, and wherein the scraper sidewall is shaped to only partially block the duct side opening.

* * * * *